US006513788B1

(12) United States Patent
Ashe

(10) Patent No.: US 6,513,788 B1
(45) Date of Patent: Feb. 4, 2003

(54) STAPLE REMOVER WITH MAGNETIC TRAP

(76) Inventor: Robert G. Ashe, 490 Morton Rd., Athens, GA (US) 30605-5008

( * ) Notice: Subject to any disclaimer, the term of this patent is extended or adjusted under 35 U.S.C. 154(b) by 0 days.

(21) Appl. No.: 10/040,377

(22) Filed: Jan. 9, 2002

(51) Int. Cl.[7] ..... B25C 11/00
(52) U.S. Cl. ..... 254/28; 227/63
(58) Field of Search ..... 254/28; 227/63

(56) References Cited

U.S. PATENT DOCUMENTS 3,625,482 A * 12/1971 Viel ..... 254/28
3,761,057 A * 9/1973 Nembhard ..... 254/28
4,054,263 A 10/1977 Delia
4,513,951 A * 4/1985 Rogers ..... 254/28
D352,217 S 11/1994 Hochfeld et al.
5,524,866 A * 6/1996 Taylor ..... 254/28
5,653,424 A * 8/1997 Khan ..... 254/28
5,957,430 A 9/1999 Olson

* cited by examiner

*Primary Examiner*—Joseph J. Hail, III
*Assistant Examiner*—Daniel Shanley
(74) *Attorney, Agent, or Firm*—Roylance, Abrams, Berdo & Goodman, L.L.P.; Tara L. Hoffman

(57) ABSTRACT

A staple remover that includes a tool having a main portion with first and second end walls, top and bottom sections that extend between the first and second end walls, and a slot that is located between the top and bottom sections and extends between the first and second end walls. A staple grasping portion for removing staples extends from the main portion. A magnetized receptacle has a receptacle portion with an access opening for receiving staples. The access opening is disposed near the staple grasping portion of the tool. A lower flange extends from the receptacle portion, and a channel is defined between the lower flange and the receptacle portion. The top section of the tool engages the channel and the lower flange of the receptacle engages the slot of the tool, thereby coupling the tool and the receptacle.

23 Claims, 2 Drawing Sheets

STAPLE REMOVER WITH MAGNETIC TRAP

FIELD OF THE INVENTION

The present invention relates to a staple remover having a magnetic trap for collecting removed staples. More specifically, the present invention relates to a staple remover formed by two connecting parts of A magnetic trap and a staple removing tool.

BACKGROUND OF THE INVENTION

Conventional staple removers include a pair of hinged opposing jaws for grasping and removing a staple. Magnets are often employed for retrieving and holding removed staples.

For example, U.S. Pat. No. 4,054,263 to Delia discloses a magnetized staple remover that has two magnetic plates attached to hinged upper and lower jaws, respectively, which capture dislodged staples. Also, U.S. Pat. No. 5,957,430 to Olson discloses a magnetized staple remover that has small magnets mounted laterally outside of hinged jaws. After a staple has been removed and the hinged jaws released, the staple is captured by the magnets.

Conventional staple removers, however, do not provide a mechanism for collecting and isolating numerous staples. Additionally, conventional staple removers do not provide a way of easily disposing the collected staples.

SUMMARY OF THE INVENTION

Accordingly, an object of the present invention is to provide a staple remover having both a tool for removing staples and a magnetic trap for collecting the removed staples.

Another object of the present invention is to provide a staple remover having a magnetic trap that captures numerous staples and is removable for easy disposal of the captured staples.

Yet another object of the present invention is to provide a staple remover having a magnetic trap that encloses the removed staples and retains them in a convenient location.

The foregoing objects are basically attained by a staple remover having a tool that has a main portion with a first engagement member, and a staple grasping portion for removing staples that extends from the main portion; a magnetized receptacle is coupled to the tool and has a receptacle portion with an access opening for receiving staples; the access opening is disposed near the staple grasping portion of the tool; and a second engagement member of the receptacle engages the first engagement member of the main portion of the tool.

The foregoing objects are also attained by a staple remover including a tool that has a main portion with first and second end walls, top and bottom sections that extend between the first and second end walls, and a slot that is located between the top and bottom sections and extends between the first and second end walls; a staple grasping portion for removing staples extends from the main portion; a magnetized receptacle has a receptacle portion with an access opening for receiving staples, the access opening is disposed near the staple grasping portion of the tool; a lower flange extends from the receptacle portion, and a channel is defined between the lower flange and the receptacle portion; and the top section of the tool engages the channel and the lower flange of the receptacle engages the slot of the tool, thereby coupling the tool and the receptacle.

By fashioning the staple remover of the present invention in this manner, a convenient mechanism is provide for both removing numerous staples and capturing and retaining the staples for disposal.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
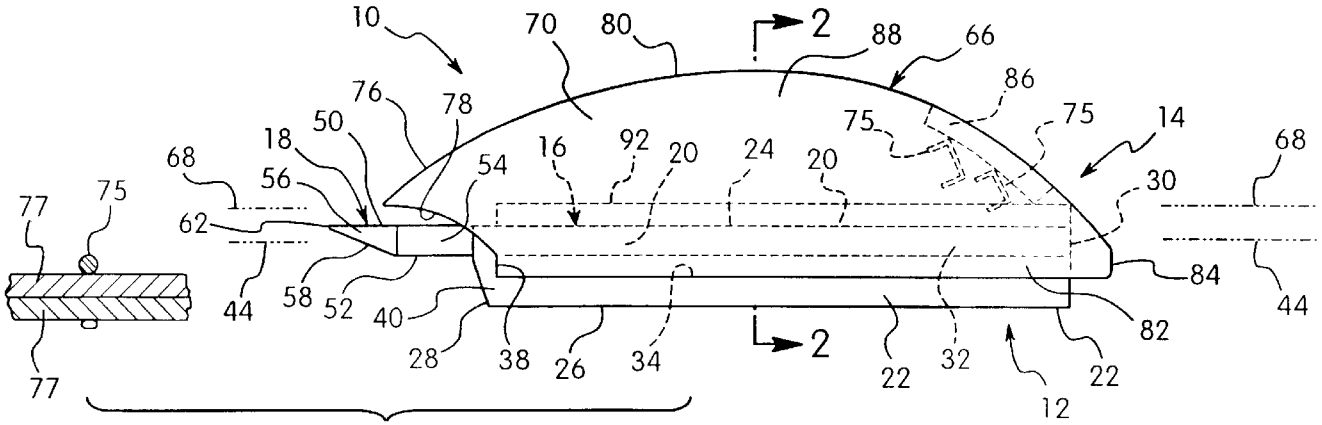
FIG. 1 is a side elevational view of a staple remover in accordance with an embodiment of the invention, showing the assembly of a staple remover tool and a receptacle.

Referring to FIGS. 1–4, a staple remover 10 in accordance with an embodiment of the present invention generally includes a tool 12 for grasping and removing staples coupled to a magnetized receptacle 14 for trapping and retaining removed staples.

Tool 12 includes a main body portion 16 with a staple grasping portion 18 extending therefrom. Main body portion 16 has top and bottom sections or walls 20 and 22 with top wall 20 defining an upper surface 24 of main body portion 16 and bottom wall 22 defining a lower surface 26 of main body portion 16. Upper and lower surfaces 24 and 26 are generally planar. Top and bottom walls 20 and 22 extend between first and second end walls 28 and 30. First end wall 28 preferably tapers from upper surface 24 to lower surface 26, and second end wall 30 is preferably substantially planar. End wall 28 can also be substantially planar.

Figure 2:
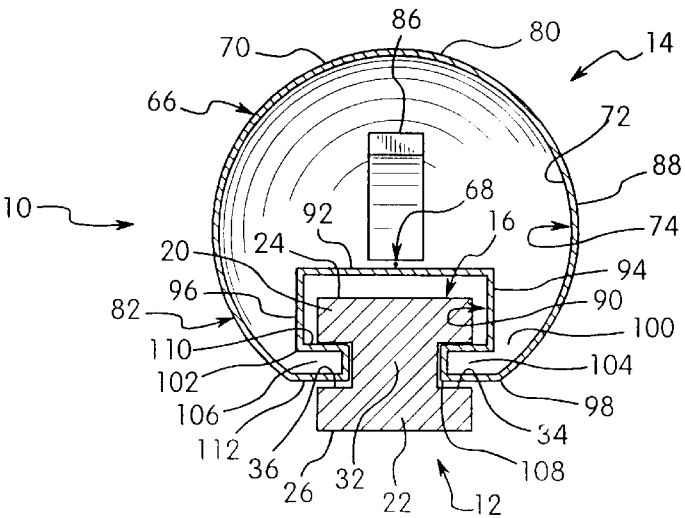
FIG. 2 is a side elevational view of the staple remover taken in section along line 2—2 of FIG. 1, but without the staples.
Figure 3:
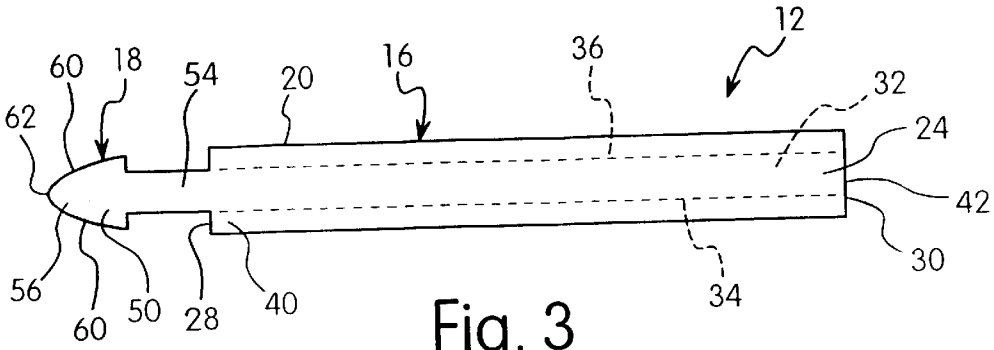
FIG. 3 is a top plan view of the tool of the staple remover illustrated in FIG. 1.

Top and bottom walls 20 and 22 of tool main body portion 16 are mated by a middle wall 32 that has a width substantially smaller than the width of each of top and bottom walls 20 and 22, thereby forming a substantially I-shaped tool main body portion 16 in cross section, as best seen in FIG. 2. Between top and bottom walls 20 and 22 and on either side of middle wall 32, respectively, are first and second slots 34 and 36 for engaging receptacle 14, as best seen in FIGS. 2 and 3, extending between first and second end walls 28 and 30. The size of each slot 34 and 36 is sufficient to accommodate a portion of receptacle 14 as described below. An inner surface 38 of main portion first end wall 28 provides a closed end 40 of slots 34 and 36. Opposite closed end 40 is an open end 42 at main portion second end wall 30. Slots 34 and 36 are generally parallel to each other and to a longitudinal axis 44 of tool main portion 16 and each extends substantially the entire length of main portion 16. Although slots 34 and 36 preferably extend substantially the entire length of main portion 16, slots 34 and 36 can extend for only a portion of the length of main portion 16, as long as slots 34 and 36 can engage receptacle 14.

As seen in FIGS. 1–4, extending from tool main portion 16 is staple grasping portion 18. Although main portion 16 and staple grasping portion 18 are preferably formed as a unitary one-piece member, they can be separately formed and integrally attached by any known attachment. Staple grasping portion 18 has upper and lower surfaces 50 and 52 with upper surface 50 being aligned and generally flush with upper surface 24 of main portion 16. Main portion end wall 28 extends beyond lower surface 50 of staple grasping portion 18. Staple grasping portion 18 preferably includes a neck extension 54 with a tapered head 56 for insertion under a staple to grasp and lift the staple, thereby removing the staple. Neck extension 54 extends from main portion first end wall 28 so that extension 54 is generally perpendicular thereto and has a smaller width than the width of top wall 20 of main portion 18, as seen in FIG. 3. However, neck extension 54 can have the same or a larger width than wall 20.

Figure 4:
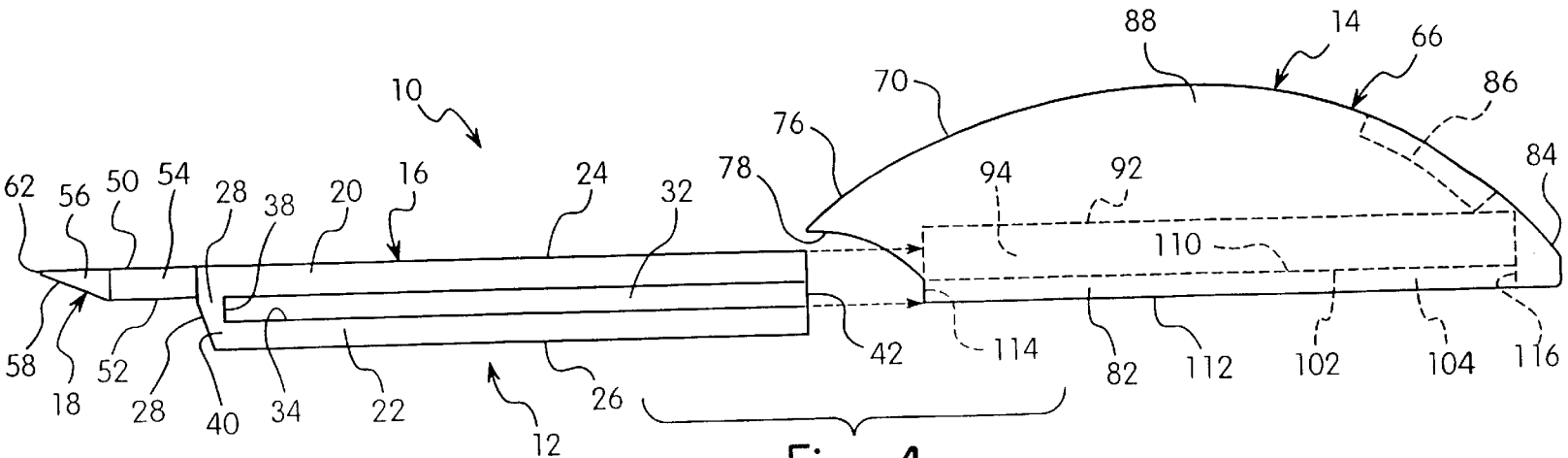
FIG. 4 is an exploded, side elevational view of the stapler remover illustrated in FIG. 1, showing the tool being coupled with the receptacle.

Tapered head 56 extends from neck extension 54 and includes a tapered bottom 58 and tapered sides 60 to facilitate insertion of tapered head 56 under a staple to be removed. Tapered bottom 58 tapers or slopes from neck extension 54 to a distal end 62 of head 56, such that the thickness of head 56 decreases from extension 54 to distal end 62, as best seen in FIGS. 1 and 4. Tapered sides 60 taper inwardly, thereby forming a generally arrow shaped head 56, as best seen in FIG. 3, with the width of head 56 being slightly wider than the width of neck extension 54. Tapered head 56 and neck extension 54 preferably have generally the same length. However, head 56 and extension 54 can have different lengths.

Although staple grasping portion 18 preferably includes neck extension 54 and tapered head 56, staple grasping portion 18 can also include any member capable of grasping a staple, such as a hooking member or cooperating hinged jaws.

As seen in FIGS. 1, 2 and 4, tool 12 is coupled with receptacle 14. Receptacle 14 includes a receptacle portion 66 that has a longitudinal axis 68 and an outer curved wall 70 that curves about longitudinal axis 68, as best seen in FIG. 2. Outer wall 70 includes an inner surface 72 and defines an inner compartment 74 for trapping and collecting staples 75 that have been removed from paper 77, as seen in FIG. 1. A first end 76 of outer wall 70 includes an access opening 78 extending between the top 80 of outer wall 70 and engagement portion 68 near the bottom 82 of wall 70. Opposite access opening 78 is a second closed end 84. Receptacle outer wall 70 substantially encloses inner compartment 74 and forms a substantially circular cross section at a mid-section 88, as seen in FIG. 2, and tapers from mid-section 88 to access opening 78 and closed end 84, respectively, as seen in FIGS. 1 and 4.

A magnet 86 is disposed within inner compartment 74 for attracting removed staples and collecting and isolating the removed staples within compartment 74. Magnet 86 is preferably rigidly attached to inner surface 72 of wall 70 near the top 80 of wall 70. However, magnet 86 can be located anywhere on inner surface 72. Magnet 86 is a rectangular member slightly curved to conform to the shape of wall 70 but can be any shape such as square or disc shaped. Also, magnet 86 can be any size provided magnet 86 attracts removed staples. Additionally, more than one magnet 86 can be employed and attached to wall inner surface 72.

Near the bottom 82 of receptacle portion 66, an engagement channel 90 is formed in compartment 74 of receptacle portion 66. Specifically, engagement channel 90 is defined by an inner lateral wall 92 extending generally the length of receptacle portion 66 and substantially parallel to longitudinal axis 68, and by two inner sidewalls 94 and 96 depending downwardly from lateral wall 92. Although channel 90 preferably extends substantially the entire length of receptacle portion 66, channel 90 can extend for only part of the length of receptacle portion provided channel 90 can engage tool 12.

First and second flanges 104 and 106 for engaging slots 34 and 36 of tool 12 extend inwardly from sidewall lower edges 100 and 102 and lower edge 98 of outer wall 70 so that first and second flanges 104 and 106 generally face one another and are substantially perpendicular to respective sidewalls 94 and 96. Slots 34 and 36 of tool 12 are sized to received flanges 104 and 106. An open bottom 108 of channel 90 is defined between first and second flanges 104 and 106. Top and bottom surfaces 110 and 112 of each respective first and second flange 104 and 106 are substantially planar. Flanges 104 and 106 extend between first and second ends 114 and 116 for generally the entire length of channel sidewalls 94 and 96, as seen in FIG. 4 (showing one flange).

Assembly and Operation

Referring to FIGS. 1–4, staple remover 10 is assembled by slidably coupling tool 12 and receptacle 14. In particular, top wall 20 and middle wall 32 of tool 12 are inserted through access opening 78 of receptacle 14 and into channel 90 of receptacle portion 66 with middle wall 32 extending through open bottom 108 of channel 90 and bottom wall 22 of tool 12 being suspended below flanges 104 and 106 of receptacle 14. Each receptacle flange 104 and 106 is slidably received in a respective slot 34 and 36 of tool main portion 16, staple grasping portion 18 of tool 12 is located near receptacle access opening 78, and tool second end wall 30 is located near receptacle closed end 84. First end 114 of first and second flanges 102 and 104 acts as a stop when inserting tool 12 by abutting inner surface 38 of tool main portion end wall 28. The engagement of tool top wall 20 and receptacle channel 90 and the engagement of receptacle flanges 104 and 106 with tool slots 34 and 36, respectively, slidably and releasably couples tool 12 and receptacle 14 for operation of staple remover 10.

To operate staple remover 10, the assembly of tool 12 and receptacle 14 is grabbed and staple grasping portion 18 is forced under a staple 75 to be removed. Tool 12 and receptacle 14 will remain coupled during operation of staple remover 10 due to the force applied to and the grasping of receptacle 14 when removing a staple. Pulling up on staple grasping portion 18 and receptacle portion 66 removes the staple 75 from paper 77. Magnet 86 magnetically attracts the removed staple which travels through receptacle access opening 78 and into receptacle inner compartment 74, thereby containing and isolating the removed staple 75. Multiple additional staples 75 can be removed and retained in compartment 74 via staple removing portion 18 and magnet 86.

Once inner compartment 74 of receptacle portion 66 is full with removed staples 75 and/or the removed staples 75 collected in compartment 74 are ready for disposal, receptacle 14 can be removed from tool 12 to allow for easy disposal of the removed staples. Specifically, inner compartment 74 can be emptied via access opening 78. Receptacle portion 66 can then be re-engaged with tool 12 in the same manner described above for removal of additional staples.

Although tool 12 and receptacle 14 are preferably coupled as described above, tool 12 and receptacle 14 can be coupled in several alternative manners. For example, slots 34 and 36 of tool 12 can be combined to form one channel (not shown) which receives flanges 104 and 106 of receptacle 14. Also, flanges 104 and 106 can be combined to form a wall (not shown) which is received in the channel of tool 12. Alternatively, fasteners, such as screws, can be employed to attach tool 12 to receptacle 14. For example, screws can extend through receptacle flanges 104 and 106 and into any portion of tool 12. In addition, tool 12 can simply be attached to the bottom or inside of receptacle 14 via screws or any known attachment, such as adhesive.

While a particular embodiment has been chosen to illustrate the invention, it will be understood by those skilled in the art that various changes and modifications can be made therein without departing from the scope of the invention as defined in the appended claims.

What is claimed is:

1. A staple remover, comprising;

a tool having a main portion with a first engagement member, and a staple grasping portion extending from said main portion adapted to lift and remove a staple from a paper; and a magnetized receptacle second engagement member coupled to said tool having a receptacle portion with an access opening for receiving the removed staple, said access opening being disposed near said staple grasping portion of said tool, and the second engagement member slidably engaging said first engagement member of said main portion of said tool.

2. A staple remover according to claim 1, wherein said receptacle is separate from and releasably coupled to said tool.

3. A staple remover according to claim 1, wherein said staple grasping portion is a tapered head.

4. A staple remover according to claim 1, wherein said first engagement member of said tool includes a slot; and said second engagement member of said receptacle includes a lower flange, said lower flange engaging said slot.

5. A staple remover according to claim 4, wherein said first engagement member includes top and bottom sections; and said second engagement member includes a channel defined between said lower flange and said receptacle portion, said channel receiving said top section of said first engagement member.

6. A staple remover according to claim 1, wherein said first engagement member of said tool includes a slot extending between first and second end walls of said main portion; and a portion of said second engagement member of said receptacle is received in said slot.

7. A staple remover according to claim 1, wherein said receptacle defines a longitudinal axis and an outer wall curved along said longitudinal axis; and said outer wall forms a substantially enclosed receptacle.

8. A staple remover according to claim 7, wherein said tool defines a longitudinal axis that is substantially parallel to said longitudinal axis of said receptacle.

9. A staple remover according to claim 1, wherein said receptacle portion includes a closed end opposite said access opening.

10. A staple remover according to claim 1, wherein a magnet is disposed within said receptacle portion of said receptacle.

11. A staple remover according to claim 1, wherein said tool is a unitary one-piece member.

12. A staple remover according to claim 1, wherein said staple grasping portion of said tool extends outside of said receptacle portion.

13. A staple remover according to claim 1, wherein said receptacle portion includes an open end at said access opening and a closed end opposite said open end for stopping said tool from sliding out of said receptacle portion.

14. A staple remover, comprising;

a tool having a main portion with first and second end walls, top and bottom sections extending between said first and second end walls, and a slot located between said top and bottom sections and extending between said first and second end walls, and a staple grasping portion extending from said main portion for removing staples; and a magnetized receptacle having a receptacle portion with an access opening for receiving staples, said access opening being disposed near said staple grasping portion of said tool, a lower flange extending from said receptacle portion, and a channel defined between said lower flange and said receptacle portion, whereby said top section of said tool engages said receptacle channel and said lower flange of said receptacle engages said slot of said tool, thereby coupling said tool and said receptacle.

15. A staple remover according to claim 13, wherein said top section of said tool is slidably received in said channel; and said lower flange of said receptacle is slidably received in said slot.

16. A staple remover according to claim 14, wherein said receptacle portion includes a closed end opposite said access opening, so that said receptacle is substantially enclosed.

17. A staple remover according to claim 14, wherein said tool and said receptacle are separable from one another; and each of said tool and receptacle is formed as a unitary one-piece member, respectively.

18. A staple remover according to claim 14, wherein said staple removing portion is a tapered head.

19. A staple remover according to claim 14, wherein said channel of said receptacle is defined between an inner wall extending between said opposing ends of said receptacle portion and said lower flange extending between said opposing ends.

20. A staple remover according to claim 14, wherein said receptacle portion defines a longitudinal axis; and said main portion of said tool defines a longitudinal axis that is substantially parallel to said longitudinal axis of said receptacle portion.

21. A staple remover according to claim 20, wherein said receptacle portion includes an outer wall curved along said longitudinal axis of said receptacle portion.

22. A staple remover according to claim 14, wherein said tool includes a second slot; and said receptacle portion includes a second lower flange that engages said second slot of said tool.

23. A staple remover according to claim 14, wherein said staple grasping portion of said tool extends outside of said receptacle portion.

* * * * *